United States Patent [19]

Kobayashi

[11] Patent Number: 4,865,574

[45] Date of Patent: Sep. 12, 1989

[54] AMUSEMENT AND INSTRUCTIONAL DEVICE

[75] Inventor: Taeko Kobayashi, Tokyo, Japan

[73] Assignee: Zokeisha Publications, Ltd., Tokyo, Japan

[21] Appl. No.: 32,777

[22] Filed: Mar. 31, 1987

[51] Int. Cl.[4] ..... A63H 33/38; B42D 19/00; G09F 1/08

[52] U.S. Cl. ..... 446/72; 446/147; 446/152; 446/487; 281/5; 281/15.1; 40/539

[58] Field of Search ..... 446/71, 72, 76, 147, 446/151, 152, 487, 488; 281/5, 15 R, 18; 434/178, 428, 429, 430, 433; 40/124.1, 421, 539

[56] References Cited

U.S. PATENT DOCUMENTS

| | | | |
|---|---|---|---|
| 299,015 | 5/1884 | Sales | 446/152 |
| 1,041,573 | 10/1912 | Baring-Gould | 446/152 |
| 1,239,033 | 9/1917 | Norwood | 446/152 |
| 2,040,363 | 5/1936 | Crum | 40/421 |
| 2,283,628 | 5/1942 | Greenwood | 434/433 |
| 3,418,748 | 12/1968 | Margolis | 40/124.1 |
| 3,715,816 | 2/1973 | White | 434/429 |
| 4,372,077 | 2/1983 | Balbuena | 446/327 X |
| 4,493,650 | 1/1985 | Kaufmann, III et al. | 434/178 |
| 4,508,515 | 4/1985 | Skolnick | 446/327 X |
| 4,597,743 | 7/1986 | Becker et al. | 446/147 X |
| 4,620,725 | 11/1986 | Maehashi | 281/31 |
| 4,702,700 | 10/1987 | Taylor | 434/178 |

FOREIGN PATENT DOCUMENTS

| | | | |
|---|---|---|---|
| 192802 | 9/1986 | Japan | 446/97 |
| 588961 | 6/1947 | United Kingdom | 40/539 |
| 738460 | 10/1955 | United Kingdom | 446/73 |
| 2137139 | 10/1984 | United Kingdom | 281/15 R |

OTHER PUBLICATIONS

Salisbury, K., Funny Fingers, Western Publishing Co., Inc., 1971.

*Primary Examiner*—Robert A. Hafer
*Assistant Examiner*—Charles H. Harris
*Attorney, Agent, or Firm*—Robin, Blecker & Daley

[57] ABSTRACT

A device for amusement and instruction comprises a succession of planar display panels, hingedly connected to collectively provide a book-like structure. The panels display words, pictures and the like. One or more of the panels displays an incomplete or partial scene within its perimeter. Adjunct display members needed to complete the partial scene are supported by such panel and/or an adjacent panel for movement from disposition within the perimeter of the book-like structure to position completing the partial scene. When the panels are disposed to provide the book-like structure, the adjunct display members may be nested within its perimeter such that the closed book-like structure is generally square, rectangular, or of other desired shape, not evidencing the presence of the adjunct display members.

2 Claims, 9 Drawing Sheets

AMUSEMENT AND INSTRUCTIONAL DEVICE

FIELD OF THE INVENTION

This invention relates generally to amusement and instruction and pertains more particularly to picture books for entertaining and educating children.

BACKGROUND OF THE INVENTION

In amusing and instructing our toddlers, we have long relied on toys and picture books. The former readily concentrate attention for extended time spans and involve the use of the toddler's hands and mind, providing a measure of eye-hand coordination along with amusement. Picture books, while not offering much by way of enhancing eye-hand coordination, have evident benefit in visual object identification and provide early familiarity with simple words and the spelling thereof. Picture books have practical advantage over toys in entertaining and educating the toddler during travel and in other cramped space situations.

A composite toy and picture book is shown in U.S. Pat. No. 4,597,743 as comprising commonly-hinged front, back and intermediate panels. The panels are sculptured to exhibit a moving vehicle and the front and back panels fixedly support the wheels of the vehicle, exteriorly of the perimeter of the book.

While the '743 patent picture book is thus also a toy, it affords a nominal measure of eye-hand coordination. Thus, the toy vehicle is simply movable along a substrate as a unit. Its only mobile parts are the wheels and these simply rotate.

SUMMARY OF THE INVENTION

The present invention has as its primary object the provision of improved composite toy and picture books.

A more particular object of the invention is to provide a picture book having enhanced toy aspects and thus offering improved hand-eye coordination character.

In attaining these and other objects, the invention provides a device comprising a succession of planar display panels, each hinged to another and collectively providing a book-like structure. The panels display words, pictures and the like. One or more of the panels displays an incomplete or partial scene within its perimeter. Adjunct display members needed to complete the partial scene are supported by such panel and/or an adjacent panel for movement from disposition within the perimeter of the book-like structure to position completing the partial scene. When the panels are stacked to provide the book-like structure, the adjunct display members may be nested within its perimeter such that the closed book-like structure is generally square, rectangular, or of other desired shape, not evidencing the presence of the adjunct display members.

In the first embodiment illustrated in the drawings, one incomplete display scene is set forth in the last panel in the succession of panels and shows the main body of a fire truck. The front part of the fire truck is disposed on the facing side of such panel and is supported for rotation clockwise to join the partial scene outwardly thereof. The fire truck rear wheel and a fireman are disposed on the rear side of the panel for counterclockwise rotation into position outwardly of the partial scene. The fire truck ladder is supported by the next adjacent panel for counterclockwise movement to complete the partial scene. In such first embodiment, the front panel also displays a partial scene and the book may thus also be used in its closed state with adjunct display members in distended rather than nested disposition.

In another illustrative embodiment of the invention, the incomplete scene is a robot torso and the hand, arms and legs of the robot are movable into view to complete the display.

The foregoing and other features and objects of the invention will become further understood from the following detailed description of such illustrative embodiments and from the drawings wherein like reference numerals identify like parts throughout.

DESCRIPTION OF THE DRAWINGS

FIG. 4(*a*) repeats FIG. 1 with the display panels in extended positions for completing the otherwise incomplete display of the front panel.

DESCRIPTION OF PREFERRED EMBODIMENTS AND PRACTICES

Figure 1:
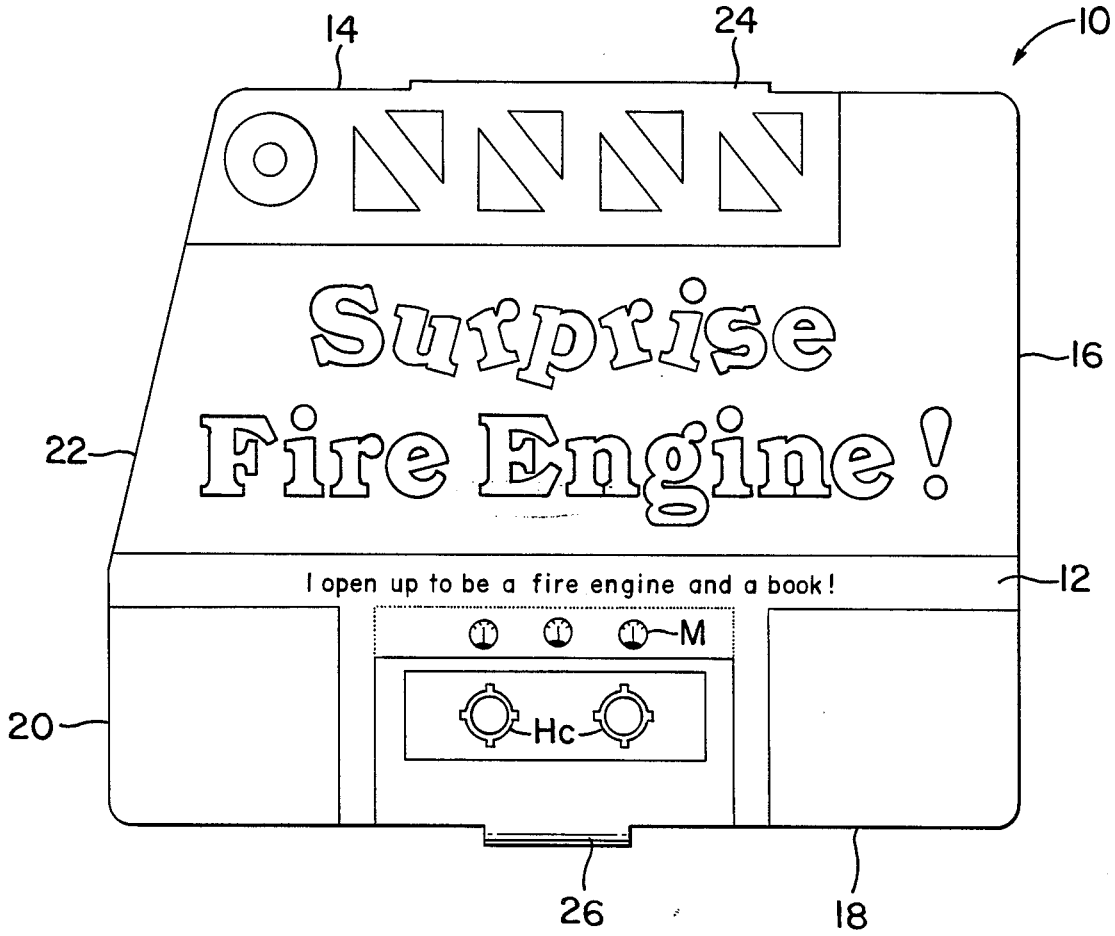
FIG. 1 is a front view of a first embodiment of the invention with the display panels disposed in closed book configuration and adjunct display members in nested positions and thus not viewable.

Referring to FIG. 1, device 10 is a composite toy and picture book and has front panel 12 of generally rectangular configuration, having top border 14, right side border 16, bottom border 18 and a left side border having parts 20 and 22. Top border 14 has a hinge 24 integral therewith and bottom border 18 includes integral latch 26.

Figure 2:
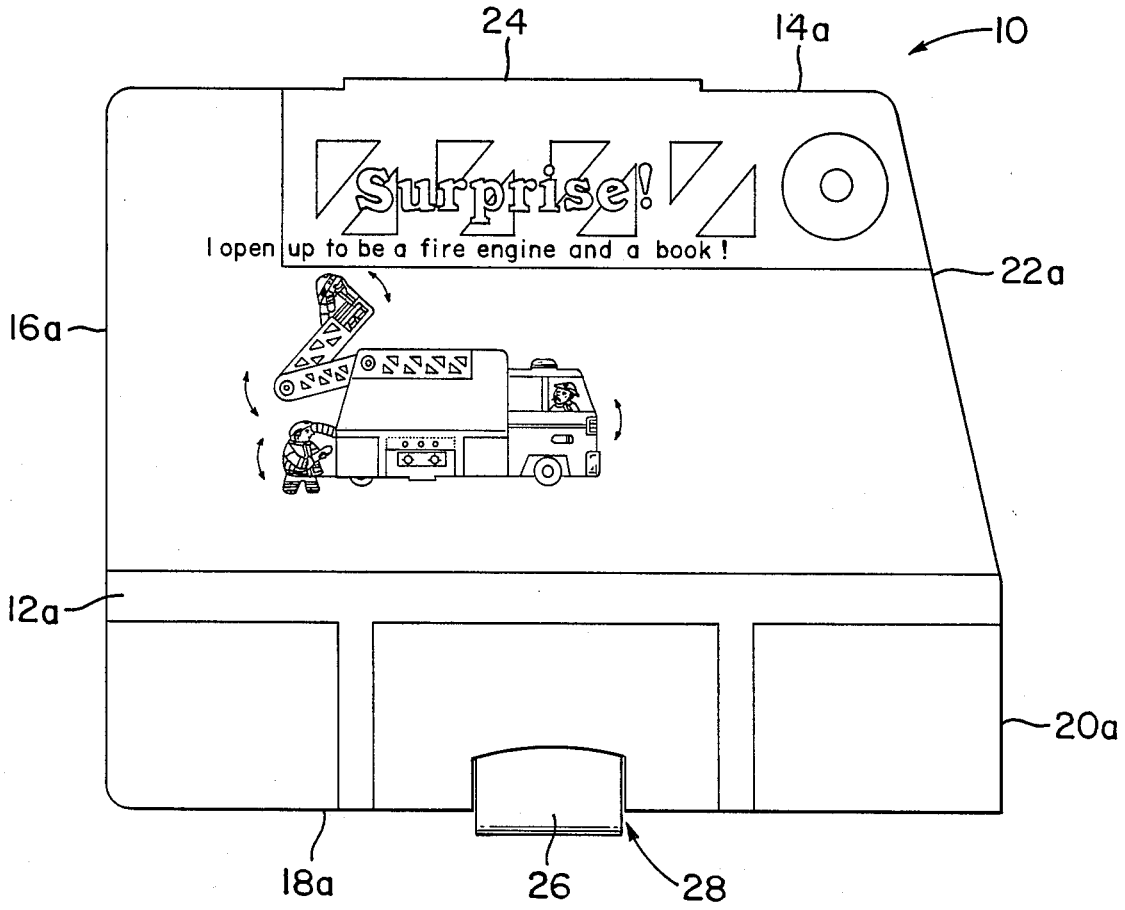
FIG. 2 is view from the rear of FIG. 1.

FIG. 2 shows rear panel 12*a* of device 10 having top border 14*a*, left side border 16*a*, bottom border 18*a* and a right side border having parts 20*a* and 22*a*. Top border 14*a* has hinge 24 also integral therewith and bottom border 18*a* has a detent opening 28 for releasably, retentively receiving latch 26 therein to effect closed book assembly of device 10.

Front panel 12 includes legends, "Surprise Fire Engine!" and "I open up to be a fire engine and a book!", and otherwise depicts parts of a fire truck main body, e.g., meters M and hose connectors HC, thus displaying an incomplete or partial scene.

Figure 3:
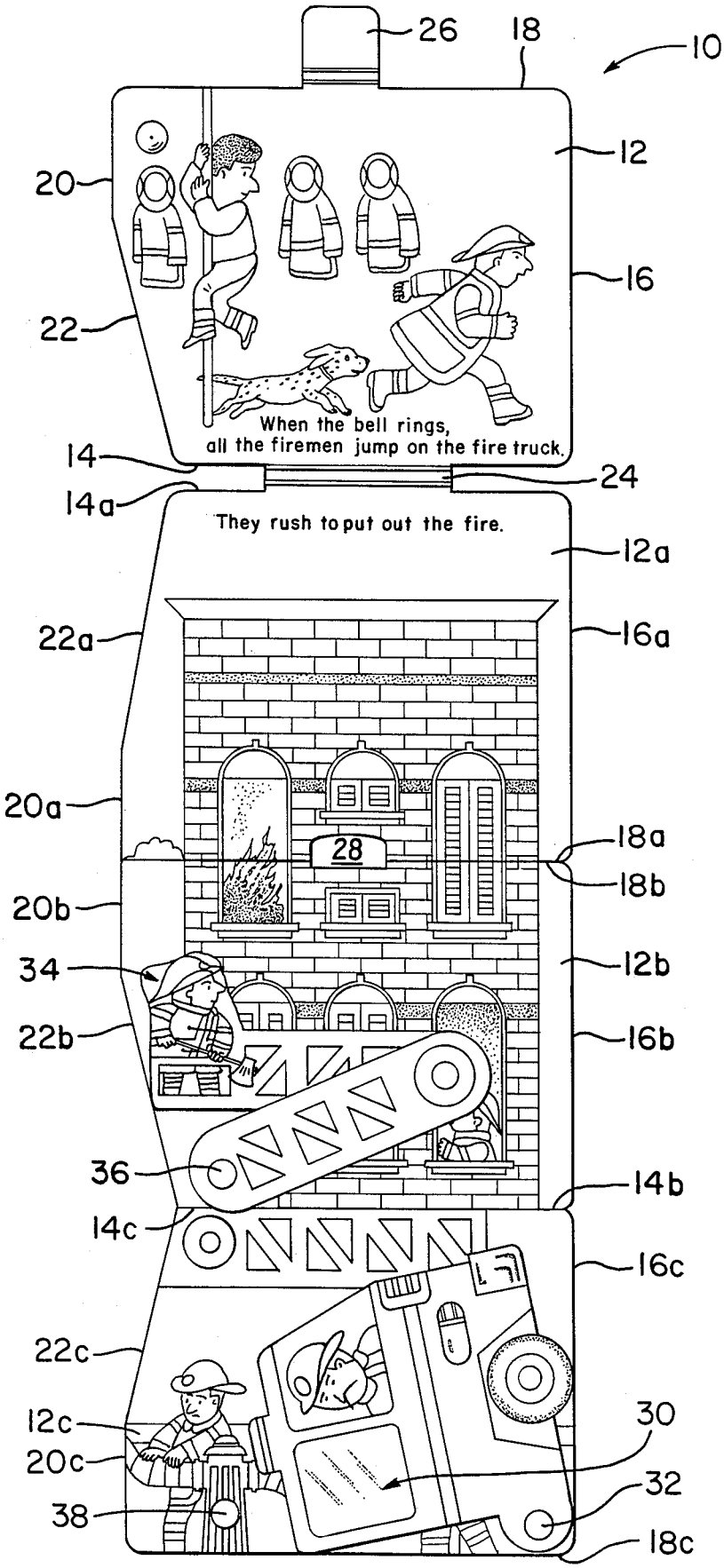
FIG. 3 is a front view of the FIG. 1 embodiment with the display panels opened and disposed in a common plane.

Referring to FIG. 3, device 10 is shown with its display panels in opened disposition, all lying in the plane of FIG. 3. Uppermost is latch 26 of panel 12, which depicts, on its side opposite its FIG. 1 side, an active or alarm fire house situation, with associated legend. Hinge 24 interconnects panels 12 and 12*a* and is of extent between borders 14 and 14*a* to permit disposition therebetween of display panels 12*b* and 12*c* when all panels are stacked into closed book configuration.

Display panel 12*a* bears a legend and also shows the upper portion of a building on fire, this panel having border parts 14*a*, 16*a*, 18*a*, 20*a* and 22. Border part 18*a* is integrally hingably connected to border part 18*b* of display panel 12*b*, which depicts the lower portion of the building on fire.

Panel 12*b* has other border parts 14*b*, 16*b*, 20*b* and 22*b*, part 14*b* being integrally hingedly connected to border part 14*c* of display panel 12*c*, which has other border parts 16*c*, 18*c*, 20*c* and 22*c*.

Display panel 12*c*, like the FIG. 1 side of display panel 12, presents an incomplete or partial scene and supports adjunct display member 30 (fire truck front end) on its FIG. 3 facing side. A rivet or pin 32 secures member 30 on panel 12*c* for rotation outwardly thereof. A second adjunct display member 34, comprising an extendable ladder with fireman is supported for movement outwardly of display panel 12*b* by rivet 36.

Figure 4:
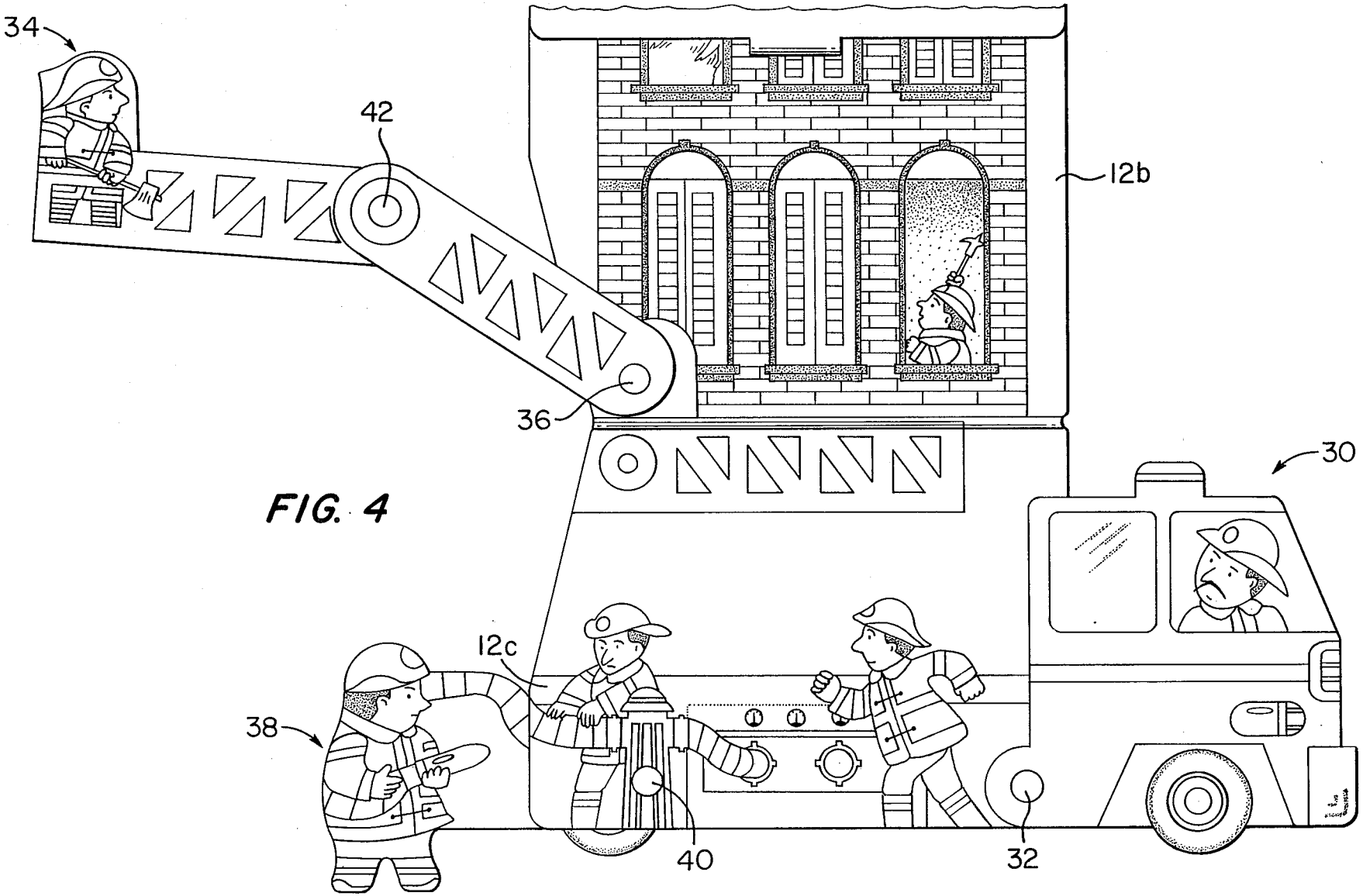
FIG. 4 repeats FIG. 3 in part with the adjunct display members moved into operative display positions.
Figure 4A:
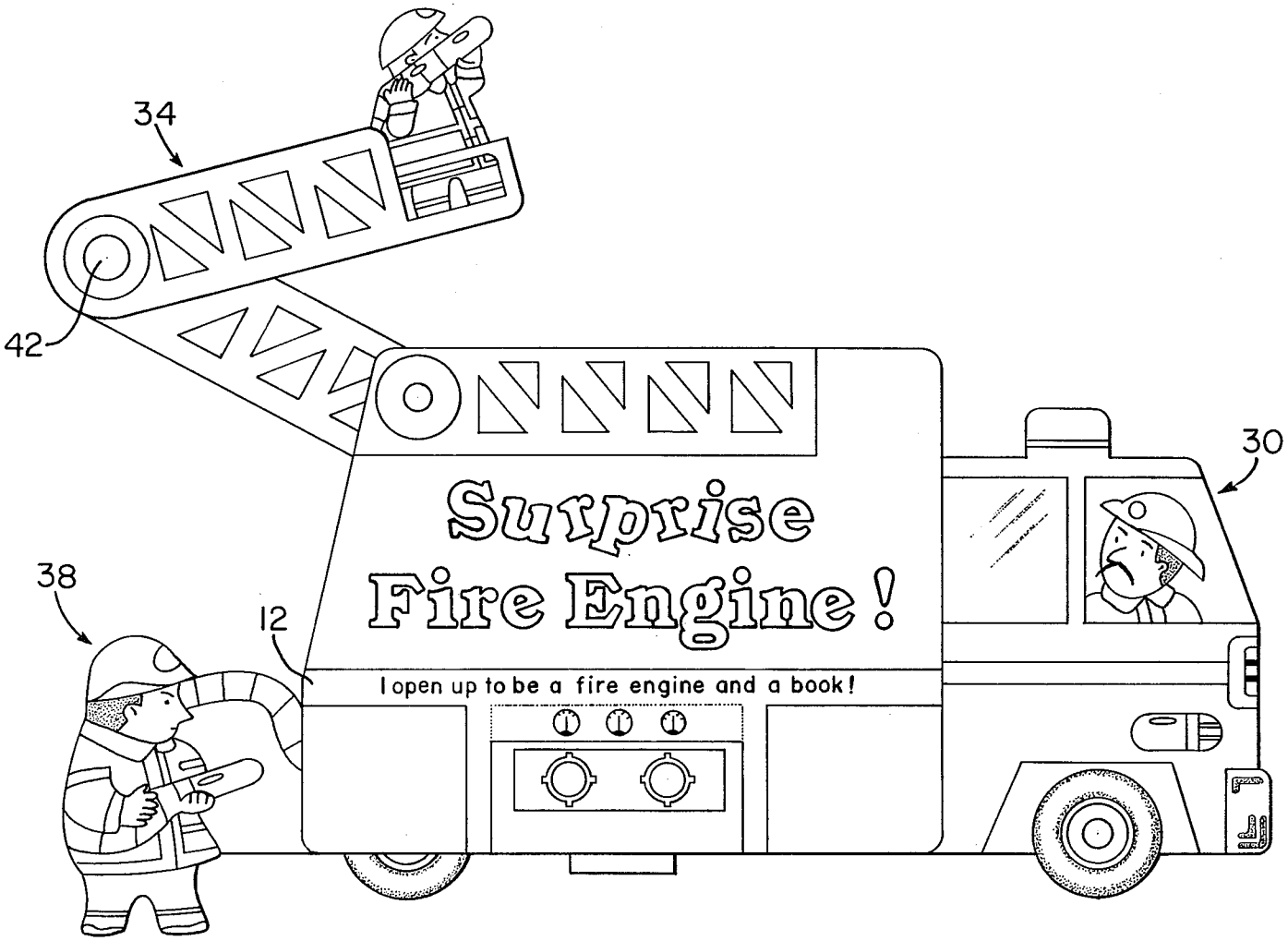

Referring to the enlarged partial showing of FIG. 4, a third adjunct display member 38 is shown extended from the rear side of panel 12*c*, rivet 40 being provided for rotatably supporting member 30. All adjunct display members are in extended, scene completing disposition in FIGS. 4.

A further option is open to the user of device 10, as is shown in FIG. 4(*a*). Here, with adjunct display members in extended positions, and with member 34 reorientated about its rivet 42, device 10 is closed and members 30, 34 and 38 complete the partial fire truck scene of front panel 12 of device 10. Alternatively, members 30, 34 and 38 are returned from their FIG. 4 dispositions to nested relation within the perimeters of panels 12*b* and 12*c* prior to closing the device, in which case one again reaches the showing of FIG. 1 wherein the adjunct display members are within the perimeter of the composite toy and picture book.

In the described embodiment, the display panels are collectively stackable and to this end, hinge 24 is of sufficient vertical extent in FIG. 3 to permit the presence between panels 12 and 12*a* of panels 12*b* and 12*c* when the picture book is closed. Likewise, latch 26 is of sufficient vertical extent in FIG. 3 to encompass all panels and to engage detent opening 28 when the picture book is closed.

Figure 5:
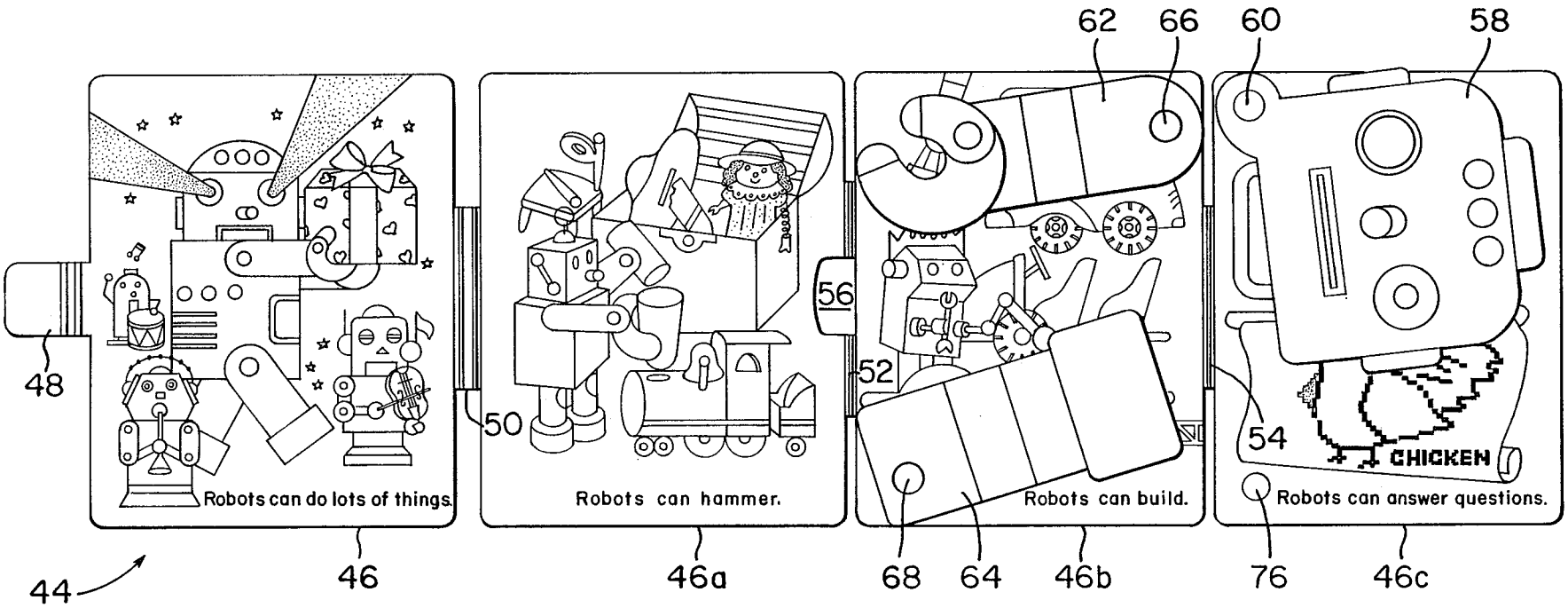
FIG. 5 is a front view of a second embodiment of the invention with the display panels opened and disposed in a common plane.

Turning to the second embodiment of the invention in FIG. 5, device 44 includes panels 46, 46*a*, 46*b* and 46*c*, all shown opened and in a common plane, i.e., that of FIG. 5. Panel 46 includes latch 48 and hinges are provided at 50, 52 and 54. Panel 46*a* defines detent 56 for releasable, retentive receipt of latch 48. Adjunct display members include the head 58 of a robot, supported rotatably by rivet 60 relative to panel 46*c*, an arm 62 and a leg 64, both rotatably supported relative to panel 46*b* by rivets 66 and 68.

Figure 6:
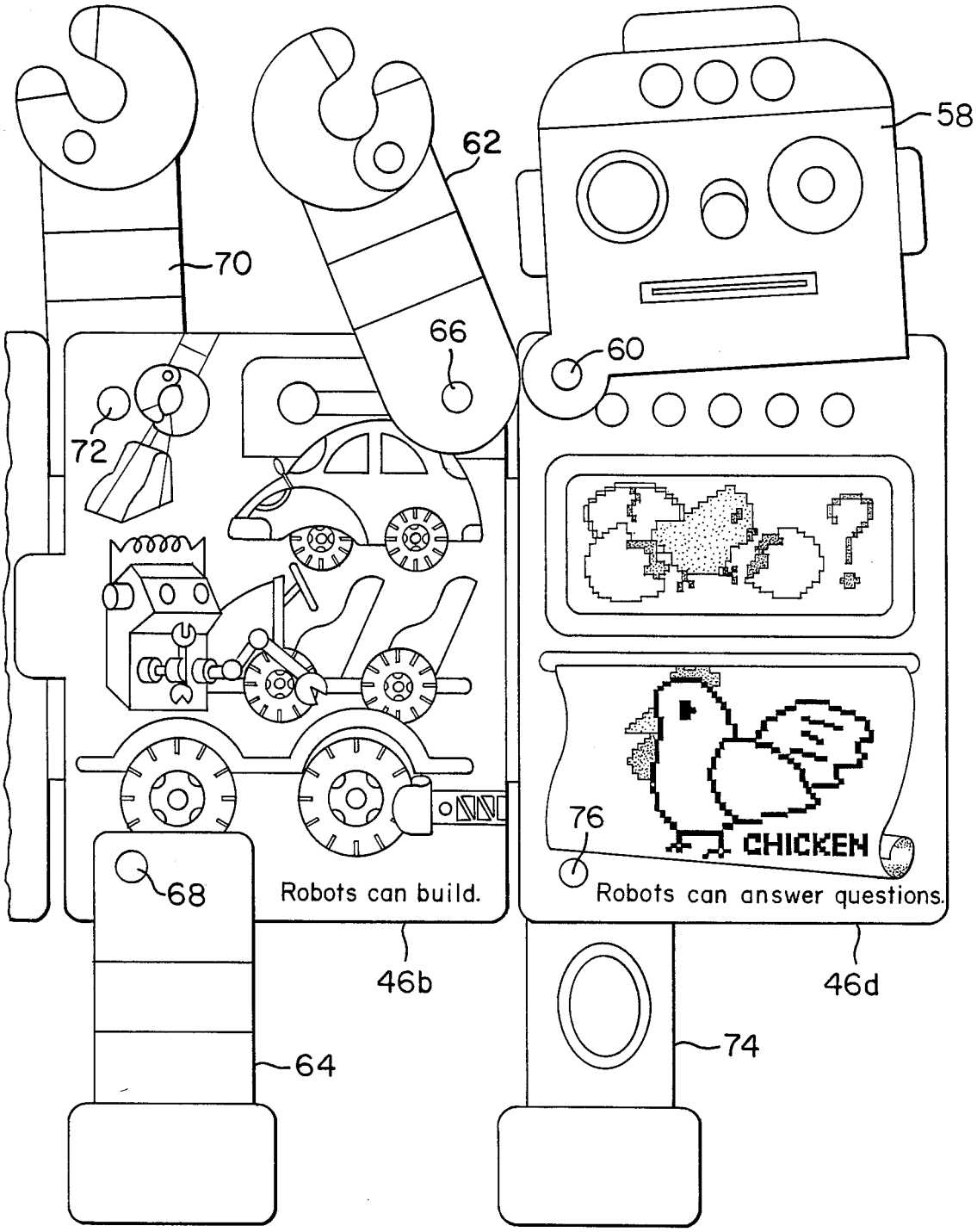
FIG. 6 repeats FIG. 5 in part with the adjunct display members moved into extended positions.

Referring to the enlarged, partial showing of panels 46*b* and 46*c* in FIG. 6, a further robot arm 70 is shown supported for rotation relative to panel 46*b* by rivet 72 and a further robot leg 74 is shown supported for rotation relative to panel 46*c* by rivet 76. All adjunct display members 58, 62, 64, 70 and 74 are shown in extended, operative positions.

Figure 7:
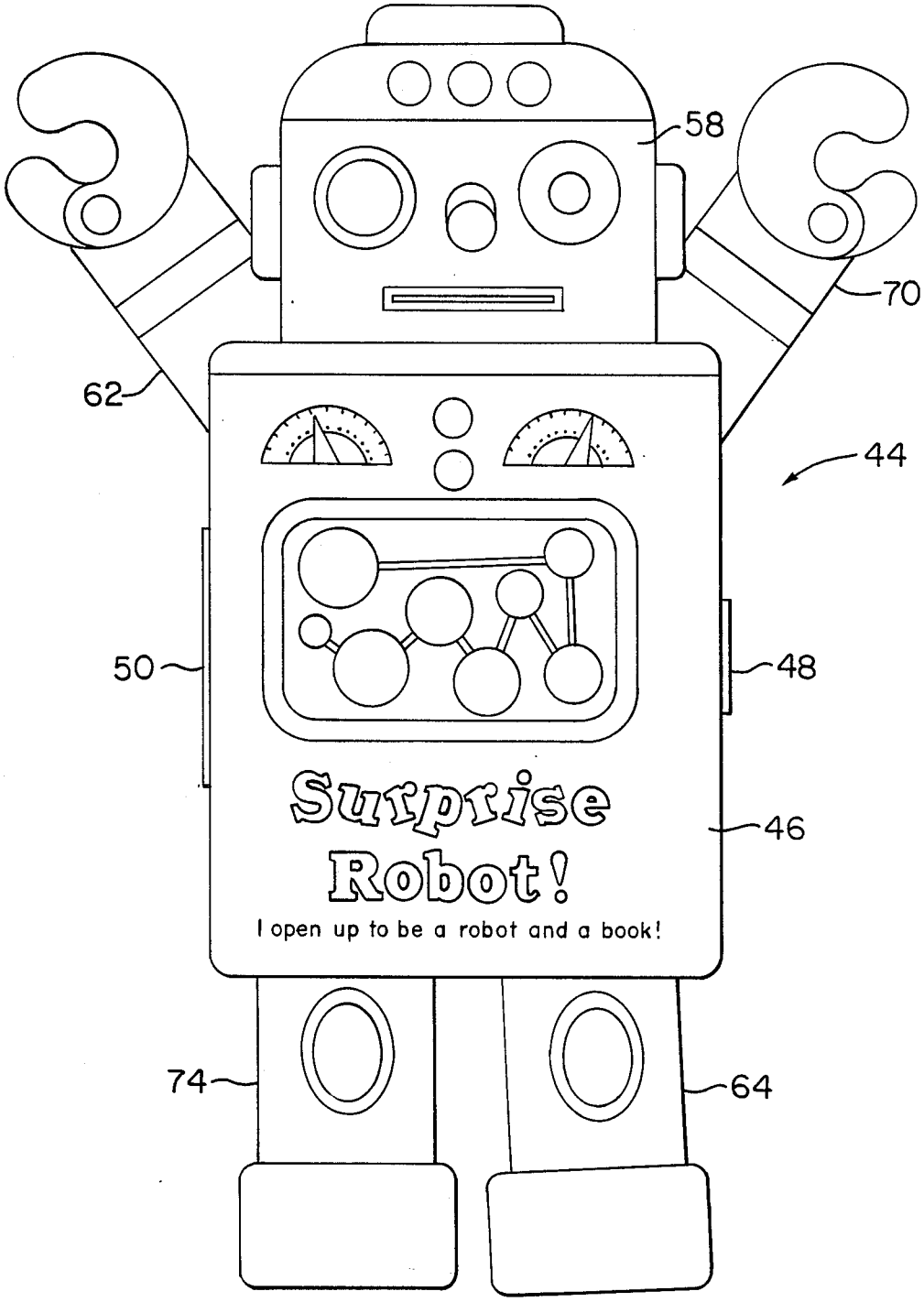
FIG. 7 is a front view of the FIG. 5 embodiment in closed book condition with the adjunct display members in operative display positions.
Figure 8:
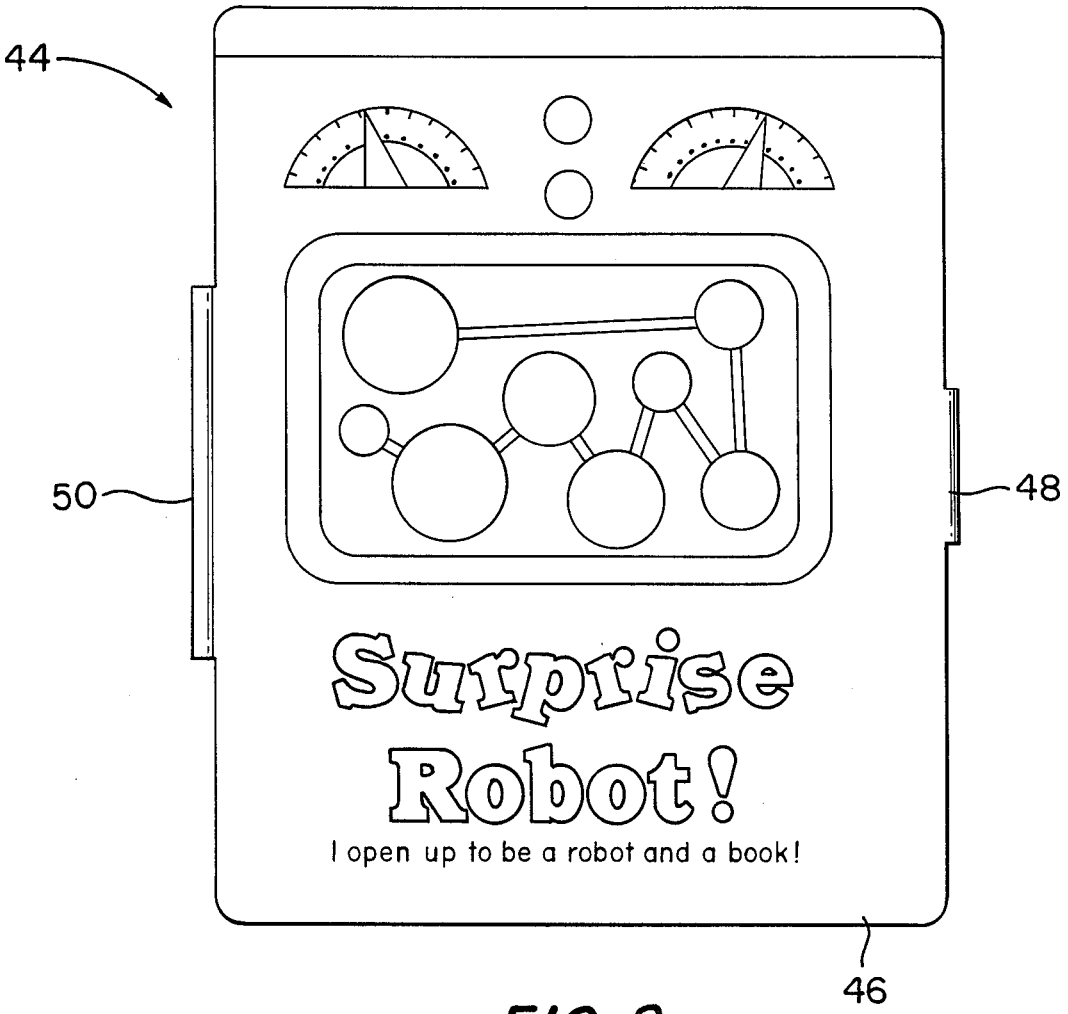
FIG. 8 is a front view of the FIG. 5 embodiment in closed book condition with the adjunct display members in nested, non-display positions.

When the panels now closed upon one another by folding, one reaches the showing of FIG. 7, wherein device 44 displays a partial scene in panel 46, namely, the robot torso, and adjunct display members 58, 62, 64, 70 and 74 are in positions completing the full showing of the robot.

In brief summary of the foregoing, the invention will be seen to provide an amusement and instructional device comprising a succession of planar display panels each hingedly connected to at least one other such display panel, at least one of such display panels defining a partial scene within its perimeter. The panels collectively provide a book-like structure and may be hingedly stackable for this purpose. Adjunct display members are provided for rendering such partial scene complete and such members are supported by at least one of the display panels for movement from disposition within the perimeter of the book-like structure to position completing the partial scene. First and successive second of the display panels include mutually cooperative interengageable means for releasably latching said book-like structure.

In the embodiments illustrated, first and second adjunct display members may be employed, each supported by different display panels for movement from disposition within the perimeter of the book-like structure to position completing such partial scene. Also, plural scenes to be completed by movement of the adjunct display members may be included in any one such device on distinct panels, which may alternately be interior to the device or comprise one of its outer covers when the picture book is in closed condition.

While the foregoing particular embodiments are of type wherein the panels are successively hinged to one another, thus to be stackable to provide the picture book, the invention contemplates the use of a hinge common to all panels, as in the customary book binding. This and various other changes may be introduced in the foregoing preferred embodiments without departing from the invention. Thus, these embodiments are intended in an illustrative and not in a limiting sense. The true spirit and scope of the invention is set forth in the following claims.

I claim:

1. An amusement and instructional device comprising:

(a) a succession of display panels in number exceeding two and a plurality of hinges, each panel being hingedly connected with at least one other said display panel by one of said hinges, at least one of said display panels defining a partial scene within its perimeter, said panels collectively providing a book-like structure; and (b) adjunct display means for rendering said partial scene complete, said adjunct display means being supported by said display panels for movement from disposition within the perimeter of said book-like structure to an extended position outside of said perimeter of said book-like structure and completing said partial scene, said book-like structure being closable with said adjunct display means in extended position, said adjunct display means comprising at least first and second rotatable adjunct display members, each of said first and second adjunct display members being rotatably supported by respective different ones of said panels for movement from within respective different sides of the perimeter of said book-like structure to positions completing said partial scene, the hinge connecting a first and a successive second of said display panels being of extent permitting disposition of remaining display panels between such first and second panels upon closing of said book-like structure, said first panel including a latching member and said second panel including a detent for the receipt of said latching member.

2. An amusement and instructional device comprising:

(a) a succession of display panels in number exceeding two and a plurality of hinges, each panel being hingedly connected with at least one other said display panel by one of said hinges, at least one of said display panels defining a partial scene within its perimeter, said panels collectively providing a book-like structure; and (b) adjunct display means for rendering said partial scene complete, said adjunct display means being supported by at least one of said display panels for movement from disposition within the perimeter of said book-like structure to an extended position outside of said perimeter of said book-like structure and completing said partial scene, said book-like structure being closable with said adjacent display means in extended position, said adjunct display means comprising at least first and second adjunct display members, each of said first and second adjunct display members being rotatably supported for movement from within respective different sides of the perimeter of said book-like structure to positions completing said partial scene, the hinge connecting a first and a successive second of said display panels being of extent permitting disposition of remaining display panels between such first and second panels upon closing of said book-like structure, said first panel including a latching member and said second panel including a detent for the receipt of said latching member.

* * * * *